United States Patent [19]

Andrews

[11] 3,986,271

[45] Oct. 19, 1976

[54] COMBINED MATERIAL FEEDER AND DRIER

[76] Inventor: Norwood H. Andrews, P.O. Box 68, Moorestown, N.J. 08057

[22] Filed: May 21, 1975

[21] Appl. No.: 579,647

[52] U.S. Cl. ..... 34/59; 34/57 R; 159/4 B; 159/6 R; 159/14; 432/58

[51] Int. Cl.[2] ..... F26B 17/24

[58] Field of Search ..... 34/102, 10, 57 E, 58, 34/59, 57 A, 57 B, 57 D, 11; 432/14, 15, 58; 210/512; 55/269; 159/4 B, 4 E, 6 R, 14

[56] References Cited

UNITED STATES PATENTS

| | | | |
|---|---|---|---|
| 3,360,870 | 1/1968 | Stephanoff | 34/57 R |

FOREIGN PATENTS OR APPLICATIONS

| | | | |
|---|---|---|---|
| 1,409,606 | 7/1965 | France | 34/59 |
| 1,040,968 | 10/1958 | Germany | 34/57 |

*Primary Examiner*—Kenneth W. Sprague
*Assistant Examiner*—James C. Yeung
*Attorney, Agent, or Firm*—Seidel, Gonda & Goldhammer

[57] ABSTRACT

An apparatus for partially drying and feeding material from an external source into a drying mill is disclosed. A conduit comprising first and second wall members and having an annular cross-section substantially throughout its acial length is connected to one end of a receiving chamber. Means are provided for guiding the material to be dried from an external source into a receiving chamber and for depositing the material in an area within the receiving chamber which is substantially coaxial with the conduit. Hot gases are introduced into the receiving chamber and propelled into and along the annular conduit with a generally circumferentially cyclonic flow. As the gas proceeds through the conduit, it carries with it the material deposited in the receiving chamber and feeds it into a drying mill.

23 Claims, 5 Drawing Figures

COMBINED MATERIAL FEEDER AND DRIER

BACKGROUND OF THE INVENTION

The present invention is directed towards a feeder for feeding material to be dried into a primary drying mill. More particularly, the present invention is directed towards an apparatus which partially dries the material before depositing it in the primary drying mill.

In many present day drying mills, especially fluid energy drying mills designed to dry liquid slurries, it is often necessary that the material to be dried be partially dried or mixed with predried material before being introduced into the drying mill. It is an object of the present invention to provide an apparatus that will both feed and partially dry the material by incorporating a hot gas cyclone dryer in a material feeder.

It is further an object of the present invention to provide a feeder which will provide a continuous flow of material into the primary dryer and will resist the build-up of material therein.

These and other objects of the invention are more specifically set forth in the following detailed description and in the accompanying drawings.

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENT

Figure 1:
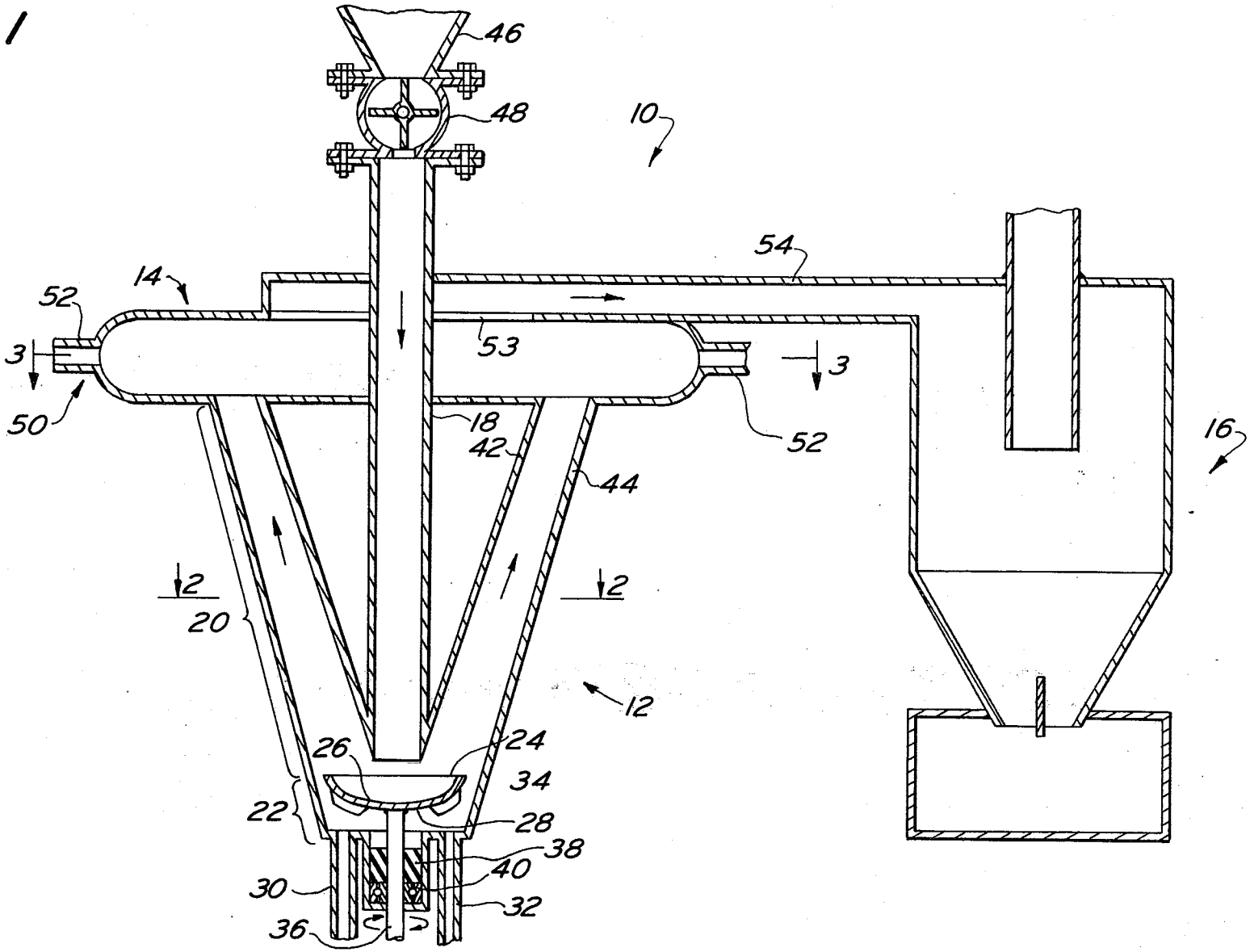
FIG. 1 is a vertical sectional view of a drying system employing a dryer constructed in accordance with the principles of the present invention.

Referring now to the drawings wherein like numerals indicate like elements, there is shown in FIG. 1 a drying system for drying slurries particularly those of a viscous nature designated generally as 10. Drying system 10 comprises a feeder 12, a fluid energy drying mill 14 and a cyclone collector 16. While feeder 12 is shown within the environment of a drying system for drying slurries of a viscous nature, it should be recognized that it may be equally utilized with other types of materials without departing from the spirit or scope of the present invention. For example, it can be used to dry liquid materials pre-mixed with dry powdered materials.

Figure 2:
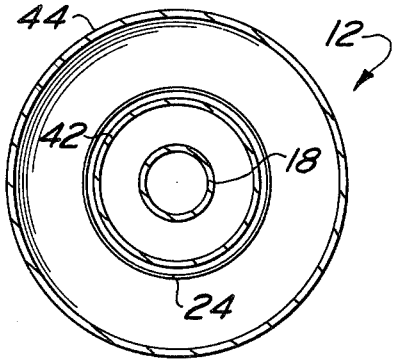
FIG. 2 is a cross-sectional view taken along 2—2 of FIG. 1.

Feeder 12 comprises a central conduit 18, an annular conduit 20, a receiving chamber 22 and a cup member 24. As best shown in FIGS. 1 and 2, central conduit 18 is preferably a circular pipe which is substantially coaxial with the central axis of feeder 12. Although conduit 18 may diverge or converge throughout its length the critical limitation on central conduit 18 is that it deposit the material to be dried in an area within receiving chamber 22 which is substantially coaxial with the central axis of feeder 12.

Cup member 24 has a concave upper surface 26 and a convex lower surface 28 whose function will be described in detail below. The upper surface of cup member 24 could be smooth or with certain viscous materials serrated in a generally radial direction. The upturned top surface gives an upward thrust to the material. Lower surface 28 may also be either smooth or serrated but is most effective if it includes some form of protrusions which will induce a circumferentially cyclonic flow in hot, low pressure gases introduced into receiving chamber 22 via pipes 30 and 32. As shown in FIG. 1, these protrusions may take the form of fins 34. It should be recognized, however, that the same result may be obtained by forming serrations in lower surface 28 which are sufficiently deep to induce the desired circumferential motion. Additionally, the hot gases could be tangentially introduced under pressure into the lower part of receiving chamber 22 thereby inducing the desired circumferentially cyclonic flow, although this means is less effective than when the desired rotation is mechanically induced.

Cup member 24 is positioned coaxially with feeder 12 and is mounted on a shaft 36 which is rotatably supported by a stuffing box 38 and a bearing 40. A motor means (not shown) rotates shaft 36 (and therefore cup member 24) at a high rate of speed. The diameter of the cup member 24 and the liquidity of viscosity of the material will have a bearing on the speed of the cup member 24. In apparatus as shown, a cup member 24 of 24 inches was rotated at a speed of 1000 rpm where the product to be dried was quite fluid. This proved to be a satisfactory rotational velocity. Greater or lesser velocities under different conditions and for different diameter cup members can be used. As indicated above, the shape of the cup portion of the cup member should be such that it minimizes the amount of material which impacts on the outer wall member 44.

An annular conduit 20 provides a passageway for the material exiting receiving chamber 22 and entering drying mill 14. As shown in FIG. 1, annular conduit 20 comprises an inner wall member 42 and outer wall member 44. In the preferred embodiment, inner wall member 42 defines the outer surface of a first truncated inverted cone. Outer wall member 44 defines the outer surface of a second inverted truncated cone having a radius which is greater than that of the truncated cone defined by inner wall member 42. Preferably, inner wall 42 diverges at a greater angle than outer wall 44 so that in cross-section, the two walls appear to converge toward each other. The difference in slope between inner wall member 42 and outer wall member 44 is chosen so that the cross-sectional area of the conduit 20 remains substantially constant. This helps ensure an upward flow of the material laden gases. It should be recognized, however, that other conduits (e.g., multi-sided rather than true conical wall members) may be utilized so long as they permit the migration of material laden fluid up conduit 20 in a substantially circumferentially cyclonic manner. The term "annular" as used herein and in the appended claims shall include such multisided figurations. Referring to FIG. 2, it can be seen that central conduit 18, inner wall member 42, cup member 24 and outer wall member 44 are all coaxial with the center axis of feeder 12.

During the operation of feeder 12, material stored in a hopper 46 is fed into feeder 12 via metering feeder 48. The material is guided into receiving chamber 22 by central conduit 18 and deposited in the central portion of cup member 24. As cup member 24 is rotated, the material impinging thereon is spun off its upper surface 26 in a radially outward and axially upward direction. As the material leaves the periphery of cup member 24, it is surrounded by hot low pressure gas introduced into receiving chamber 22 via pipes 30 and 32. Before the material can impinge on the walls of either receiving chamber 22 or annular conduit 20, the gas exiting receiving chamber 22 which has been given a circumferentially cyclonic direction by fins 34 (FIG. 1) intercepts the material and carries it up through annular conduit 20 as a result of the pressure differential between the gas entering and leaving conduit 20. More particularly, the gas entering conduit 20 from receiving chamber 22 is at a higher pressure than the gas leaving conduit 20 and entering mill 14. Inner wall 42, by restricting the cross-sectional area of the exit of conduit, 20 helps in maintaining this pressure differential. Although the pressure may be varied according to the needs of the drying system 10, the preferable range of pressure for the hot gas introduced through pipes 30 and 32 is 0.7 to 10 inches of mercury. As the material rises up annular conduit 20, it will be partially dried as a result of the extra travel distance resulting from the cyclonic motion of the hot gases. While the exact length of annular conduit 20 is not critical, it must be elongated in order that the material passing through annular conduit 20 into a conventional drying mill (in the preferred embodiment drying chamber 50) will be sufficiently dried so that it can be satisfactorily fed into any conventional drying mill. As used herein, the term "elongated conduit" shall mean that the axial length of annular conduit 20 is at least as great as the radial width thereof.

As the material leaves the uppermost portion of annular conduit 20, it enters a primary drying mill 14. While primary drying mill 14 has been illustrated as a conventional micronizer type jet dryer, it should be recognized that other types of dryers such as the fluid energy drying mill shown in U.S. Pat. No. 3,667,131, could be utilized without departing from the spirit or scope of the present invention.

Figure 3:
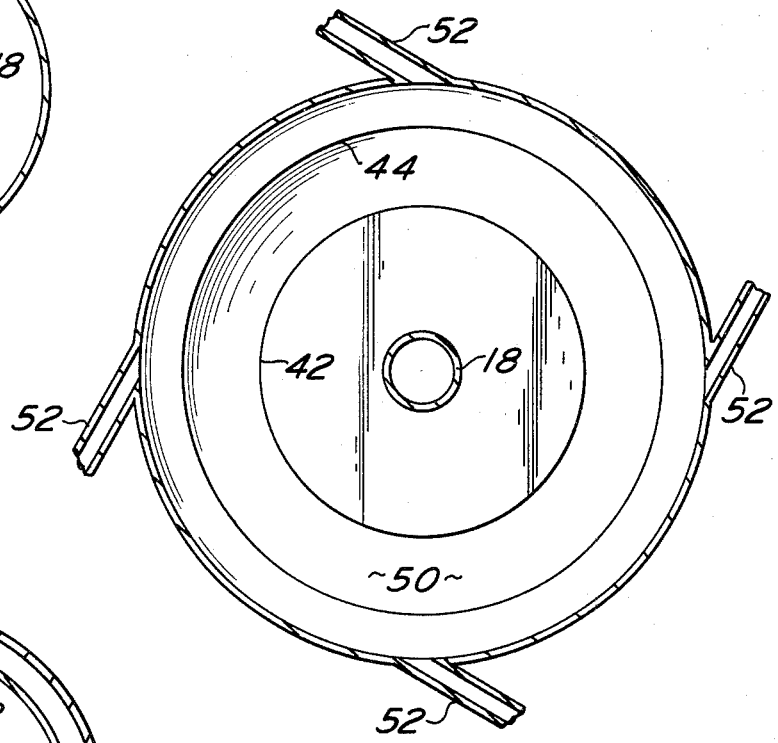
FIG. 3 is a cross-sectional view taken along 3—3 of FIG. 1.

Referring again to FIG. 1, the material leaving annular conduit 20 enters the main drying chamber 50 of primary drying mill 14. The material in drying chamber 50 is circulated in a circumferentially cyclonic direction by low pressure gases introduced tangentially into drying chamber 50 via nozzles 52. As best shown in FIG. 3, nozzles 52 direct low pressure hot gases into drying chamber 50 at an angle which will cause the desired circumferentially cyclonic motion of the material being dried it being understood that the direction of rotation in mill 14 is the same as that in conduit 20. As the material rotating in drying chamber 50 dries, it becomes lighter and migrates toward the central portion of drying chamber 50 where it exits through transfer duct 54 and is deposited into cyclone collector 16. The diameter of opening 53 through which the dried material enters the transfer duct 54 as well as the height of the drying mill are adjusted to reduce the internal pressure so that it does not become greater than the pressure at the top of annular conduit 20 where material laden gas enters the mill 14. Cyclone collector 16 is of the ordinary type and need not be described herein.

Figure 4:
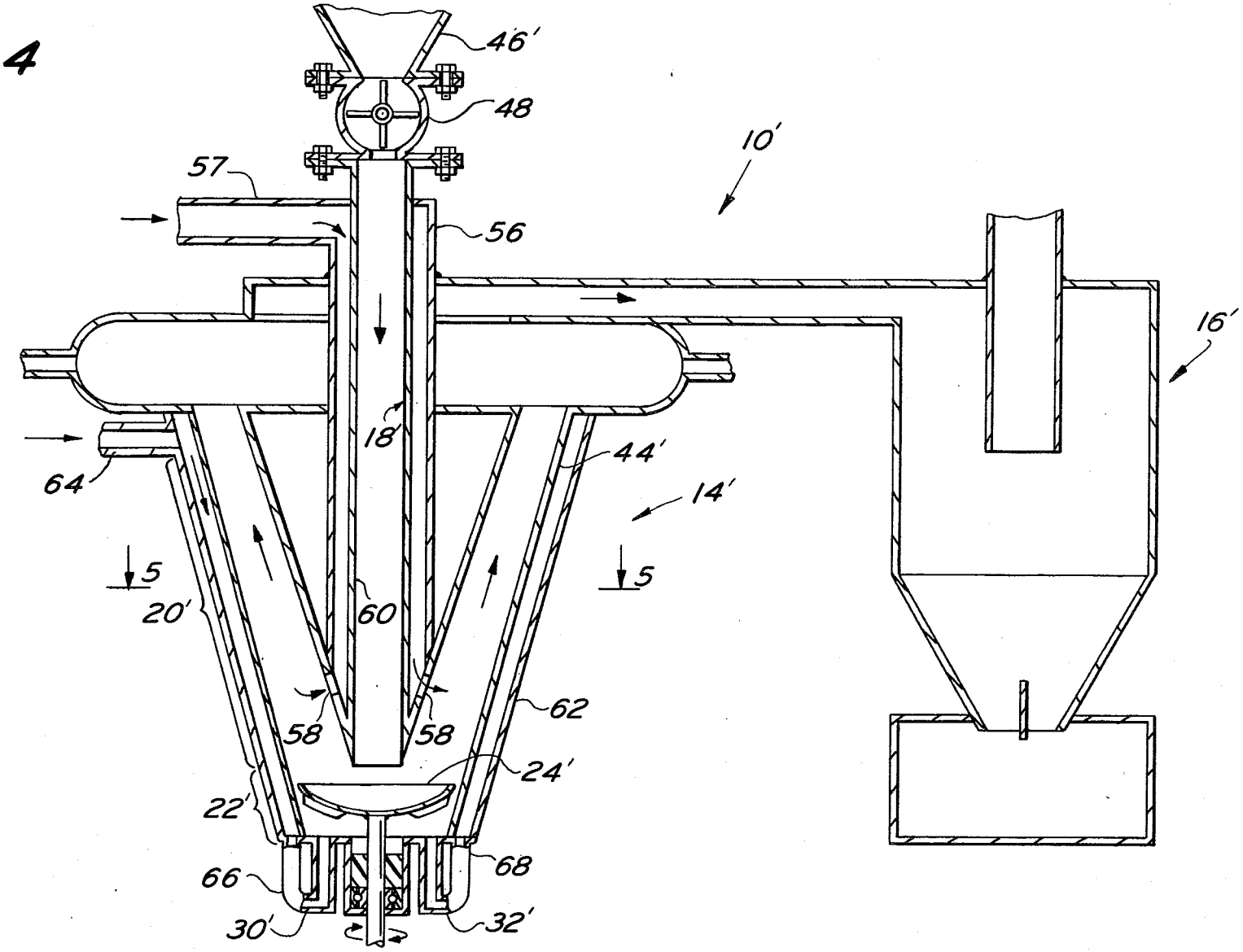
FIG. 4 is a vertical sectional view of a drying system employing a second embodiment of a feeder constructed in accordance with the principles of the present invention.

In most applications, the high rotational and upward velocity of the gases surrounding the material being dried prevents the material from impinging on wall 44 thereby avoiding an undesirable build-up of material. However, when feeding certain types of materials, particularly those with a high viscosity, further apparatus must be provided to assure a continuous even flow of material. A second embodiment of the present invention providing the necessary apparatus is illustrated in FIG. 4. With the exception noted, the apparatus shown in FIG. 4, is identical to that shown in FIG. 1. Elements of FIG. 4 which correspond to those of FIG. 1 are indicated by way of a prime following the indicating numeral.

In the embodiment illustrated in FIG. 4, the build-up of material within conduit 18′ and 20′ is minimized by the circulation of hot gas around central conduit 18′ and through annular conduit 20′. More particularly, hot gas is introduced into sleeve 56 at entrance port 57 and circulates around central conduit 18′ and into annular conduit 20′ via openings 58 in inner wall member 42′ of annular conduit 20′. The heat added to the outer wall 60 of central conduit 18′ by the gas circulating through sleeve 56 minimizes the build-up of material within central conduit 18′ by forming a gaseous sleeve along the inner surface of wall 60. More particularly, as the damp material comes into contact with the inner surface of wall 60 a portion of the moisture in the material vaporizes and forms a gaseous sleeve which the material being dried slides down. The additional hot gas introduced into annular conduit 20′ through openings 58 helps prevent a build-up of material in annular conduit 20′ by further drying the material therein.

Under certain conditions, the introduction of hot gas into annular chamber 20′ even though circulating and with upward thrust may not in itself be sufficient to prevent a build-up of material within annular conduit 20. In such circumstances, it is desirable to circulate hot gas around outer wall member 44′ of annular conduit 20′. For this purpose, hot gas is introduced into collar 62 via entrance port 64. The gas encircles annular conduit 20′ thereby heating outer wall member 44. As such, a gaseous collar forms around the inner surface of outer wall member 44′ in much the same manner as the gaseous collar is formed around the inner surface of wall 60 of central conduit 18′. As shown in FIG. 4, when collar 62 is provided, pipes 30′ and 32′ may be fed directly from collar 62 via pipes 66 and 68. In drying particularly heat sensitive materials cooling means may be introduced into port 64 and in encircling conduit 20′ cools the surface 44′. When this procedure is desirable the hot gases supplying chamber 22 will be by the same means as in FIG. 1.

Figure 5:
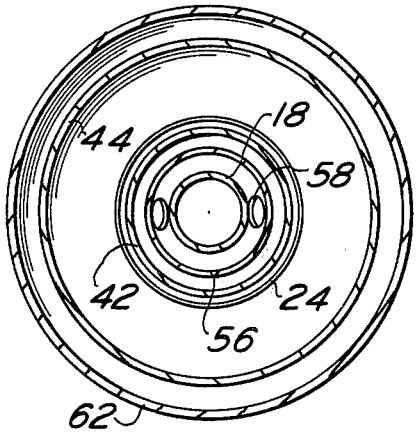
FIG. 5 is a cross-sectional view taken along line 5—5 of FIG. 4.

As best illustrated in FIG. 5, central conduit 18′, collar 56, inner wall member 42′, cup member 24′, outer wall member 44′ and collar 62 are all coaxial with the central axis of feeder 14.

The operation of the embodiment shown in FIG. 4 is substantially identical to that of the embodiment shown in FIG. 1 and will not, therefore, be reiterated herein.

The present invention may be embodied in other specific forms without departing from the spirit or essential attributes thereof and, accordingly, reference should be made to the appended claims, rather than to the foregoing specification as indicating the scope of the invention.

What is claimed is:

1. Apparatus for partially drying and feeding material from an external source into a drying mill, comprising:

a receiving chamber;

inner and outer wall members defining an elongated conduit having an annular cross-section substantially throughout its axial length, one end of said conduit being coupled to said receiving chamber, the remaining end of said conduit adapted to be coupled to a drying mill;

means for guiding the material to be dried from an external source into said receiving chamber and for depositing the material in an area within said receiving chamber which area is substantially co-axial with said conduit;

means for introducing hot gas into said receiving chamber; and impulse means for propelling both the hot gas introduced into and the material deposited in said receiving chamber into and along said annular conduit with a generally circumferentially cyclonic flow in order that the material be partially dried while it proceeds through said conduit in the direction of said remaining end.

2. Apparatus in accordance with claim 1, wherein said impulse means comprises:

a cup having a concave upper surface which is both substantially coaxial with and facing said conduit;

means for positioning said cup so that the material deposited in said receiving chamber impinges thereon;

means for rotating said cup so that the material impinging thereon is propelled in the general direction of said conduit; and means for propelling the hot gas in a generally circumferentially cyclonic direction.

3. Apparatus according to claim 2 wherein said concave upper surface of said cup is serrated in a generally radial direction.

4. Apparatus in accordance with claim 2 wherein said means for propelling the hot gas in a generally circumferentially cyclonic direction comprises projections on the lower surface of said cup which cause the gas introduced into said receiving chamber to flow in a generally circumferentially cyclonic direction.

5. Apparatus in accordance with claim 1 including means for heating said conduit.

6. Apparatus in accordance with claim 1 including means for introducing hot gas into said conduit exclusive of said receiving chamber.

7. Apparatus in accordance with claim 1 wherein said first and second wall members each define the outer surface of a different coaxial inverted truncated cone.

8. Apparatus in accordance with claim 1 wherein the spacing between said inner and outer wall members decreases throughout the axial length of said wall members with the larger spacing being adjacent said receiving chamber and the narrower spacing being adjacent to the remaining end adapted to be coupled to a drying mill.

9. Apparatus for partially drying and feeding material from an external source to a drying mill, comprising:

a receiving chamber;

an elongated annular conduit defined by inner and outer wall members, said inner and outer wall members each defining the outer surface of a different co-axial inverted truncated cone, one end of said annular conduit being coupled to said receiving chamber, the remaining end of said annular conduit adapted to be coupled to a drying mill;

central conduit means at least partially located both within and substantially co-axial with said annular conduit for guiding the material to be dried from an external source into said receiving chamber and for depositing the material in an area within said receiving chamber which is substantially co-axial with said annular conduit;

means for introducing hot gas into said receiving chamber; and impulse means for propelling both the hot gases introduced into and the material deposited in said receiving chamber into and along said conduit with a generally circumferentially cyclonic flow in order that the material be partially dried while it proceeds through said conduit in the direction of said remaining end.

10. Apparatus in accordance with claim 9 wherein said impulse means comprises:

a cup having a concave upper surface which is both substantially coaxial with and facing said conduit;

means for positioning said cup so that the material deposited in said receiving chamber impinges thereon;

means for rotating said cup so that the material impinging thereon is propelled in the general direction of said conduit; and means for propelling the hot gas in a generally circumferentially cyclonic direction.

11. Apparatus in accordance with claim 10 wherein said means for propelling the hot gas in a generally circumferentially cyclonic direction comprises projections on the lower surface of said cup which cause the gas introduced into said receiving chamber to flow in a generally circumferentially cyclonic direction.

12. Apparatus in accordance with claim 9 including means for heating said annular conduit.

13. Apparatus in accordance with claim 9 including means for introducing hot gas into said annular conduit exclusive of said receiving chamber.

14. Apparatus in accordance with claim 9 including means for heating said central conduit means.

15. Apparatus in accordance with claim 9 wherein the cross-sectional area between said inner and outer wall members is substantially constant throughout the axial length of said conduit.

16. Apparatus in accordance with claim 9 wherein said impulse means propels the material deposited in said receiving chamber into and along said conduit in such a manner as to minimize the amount of material which impacts on said outer wall member.

17. Apparatus in accordance with claim 10 wherein said concave upper surface is of sufficient concavity to propel the material deposited in said receiving chamber in a direction which will minimize the amount of material which impacts on said outer wall member.

18. Apparatus in accordance with claim 1 wherein said impulse means propels the material deposited in said receiving chamber into and along said annular conduit in such a manner as to minimize the amount of material which impacts on said outer wall member.

19. Apparatus in accordance with claim 2 wherein said concave upper surface is of sufficient concavity to propel the material deposited in said receiving chamber in a direction which will minimize the amount of material which impacts on said outer wall member.

20. Apparatus in accordance with claim 1 wherein the cross-sectional area between said inner and outer wall members is substantially constant throughout the axial length of said conduit.

21. Apparatus for partially drying and feeding material from an external source into a drying mill, comprising:

a receiving chamber;

inner and outer wall members defining a conduit having an annular cross-section substantially throughout its axial length, one end of said conduit being coupled to said receiving chamber, the remaining end of said conduit adapted to be coupled to a drying mill;

means for guiding the material to be dried from an external source into said receiving chamber and for depositing the material in an area within said receiving chamber which area is substantially coaxial with said conduit;

means for introducing hot gas into said receiving chamber; and impulse means for propelling both the hot gas introduced into and the material deposited in said receiving chamber into and along said conduit with a generally circumferentially cyclonic flow in such a manner as to minimize the amount of material which impacts on said outer wall member whereby material may be partially dried while it proceeds through said conduit in the direction of said other end.

22. Apparatus in accordance with claim 21 wherein said impulse means comprises:

a cup having a concave upper surface of sufficient concavity to propel the material deposited in said receiving chamber in a direction which will minimize the amount of material which impacts on said outer wall member, said cup being both substantially co-axial with and facing said conduit;

means for positioning said cup so that the material deposited in said receiving chamber impinges thereon;

means for rotating said cup so that the material impinging thereon is propelled in the general direction of said conduit; and means for propelling the hot gases in a generally circumferentially cyclonic direction.

23. Apparatus in accordance with claim 21 wherein the cross-sectional area between said inner and outer wall members is substantially constant throughout the axial length of said conduit.

* * * * *